US008245816B2

(12) United States Patent
Guinart Pallares

(10) Patent No.: US 8,245,816 B2
(45) Date of Patent: Aug. 21, 2012

(54) INTEGRAL SAFETY SYSTEM WHICH CAN BE USED FOR CONSTRUCTION

(76) Inventor: Jose Ramon Guinart Pallares, Tortosa (ES)

( * ) Notice: Subject to any disclaimer, the term of this patent is extended or adjusted under 35 U.S.C. 154(b) by 636 days.

(21) Appl. No.: 11/720,723

(22) PCT Filed: Dec. 1, 2005

(86) PCT No.: PCT/ES2005/000659
§ 371 (c)(1),
(2), (4) Date: May 22, 2009

(87) PCT Pub. No.: WO2006/058949
PCT Pub. Date: Jun. 8, 2006

(65) Prior Publication Data

US 2010/0025151 A1 Feb. 4, 2010

(30) Foreign Application Priority Data

Dec. 1, 2004 (ES) ..... 200402891
Mar. 15, 2005 (ES) ..... 200500601

(51) Int. Cl.
*E04G 5/00* (2006.01)

(52) U.S. Cl. ..... 182/82; 182/138; 182/229; 52/223.13; 248/231.9; 248/231.91; 411/344

(58) Field of Classification Search ..... 182/82, 182/229, 138; 52/223.13; 411/344–346; 248/231.9, 231.91
See application file for complete search history.

(56) References Cited

U.S. PATENT DOCUMENTS

| | | | | | |
|---|---|---|---|---|---|
| 596,151 | A | * | 12/1897 | Funcke | 182/87 |
| 1,141,554 | A | * | 6/1915 | Klumpp | 52/711 |
| 2,893,786 | A | * | 7/1959 | Faye | 182/82 |
| 3,131,784 | A | * | 5/1964 | Jackson | 182/229 |
| 3,640,126 | A | * | 2/1972 | Te'eni | 73/845 |
| 3,728,761 | A | * | 4/1973 | Holly | 411/80.1 |
| 3,881,699 | A | * | 5/1975 | Nusbaum | 256/59 |
| 3,949,834 | A | * | 4/1976 | Nusbaum | 182/138 |
| 4,129,197 | A | * | 12/1978 | Preston | 182/82 |
| 4,293,259 | A | * | 10/1981 | Liebig | 411/32 |
| 2006/0090961 | A1 | * | 5/2006 | Rexroad | 182/138 |
| 2008/0302035 | A1 | * | 12/2008 | Shin | 52/223.13 |

FOREIGN PATENT DOCUMENTS

| | | | | |
|---|---|---|---|---|
| DE | 3840761 | A1 | * | 6/1990 |
| EP | 143035 | A2 | * | 5/1985 |
| EP | 611257 | A1 | * | 8/1994 |
| FR | 2604469 | A1 | * | 4/1988 |

* cited by examiner

*Primary Examiner* — Alvin Chin Shue
(74) *Attorney, Agent, or Firm* — Sanchelima & Associates, P.A.

(57) ABSTRACT

This system includes support pieces (1, 1*a*) intended to be permanently fixed to the structure of the construction, interchangeable supports (30) fitted with a fixing device (4) for attachment to any of the support pieces (1, 1*a*) and with means of attachment for safety devices or load-bearing devices, intermediate supports (5, 14, 18) that can be coupled to the interchangeable supports and safety elements that can be coupled to the intermediate supports and/or the interchangeable supports. These protective elements include: head pieces (6) of lifelines, modular masts, angled brackets for attaching safety nets (9), protective canopies, safety guard masts (15), telescopic baseboards (16), extendible railings (17) and auxiliary railings (19).

7 Claims, 18 Drawing Sheets

INTEGRAL SAFETY SYSTEM WHICH CAN BE USED FOR CONSTRUCTION

BACKGROUND OF THE INVENTION

1. Field of the Invention

This invention refers to a complete safety system applicable to construction sites of the type that consist of a number of support pieces with tubular configuration, intended to be fixed permanently to the structure of the construction by incorporating them into the frame and/or by welding them to the metal structure of the frame, leaving one of the openings of these tubular parts accessible.

2. Description of the Related Art

The construction of structures presents specific problems in terms of worker protection, particularly of carpenters and form setters, as their work takes place during the construction process and there are construction areas in which it is particularly difficult to install suitable protective measures. This problem also exists when repair or maintenance work is taking place on the finished construction, as it is often necessary to use scaffolding, lifelines or other systems for securing harnesses for the attachment of workers, hoists or specific apparatus, such as for the external cleaning of windows or facade enclosures. Structures do not usually have appropriate equipment for the secure and reliable support of these elements.

At present, these problems are resolved specifically and individually, using various non-standard elements, so that the anchors or supports used to install a specific protection or support element cannot be adapted to other, different elements.

For example, in the field of construction, widespread use is made of safety nets to prevent workers falling long distances, with these nets and their supports frequently fixed by cords to the columns or structure of the building. The fixing points for safety cables for form setters are fixed to metal posts that are mounted on sleeves or supports built into the concrete or soldered to the metal structure of the structure under construction. In other cases, these cables are fixed to posts that have a perforated plate at the lower end so that they can be screwed on to the frame, or support clamps that grip onto a floor of the frame.

Protective canopies to prevent rubble or other materials falling down to the pavement below are usually positioned using a number of horizontal brackets positioned to jut out and fixed using screws and/or welded to the frame or to the facade of the building on which work is being carried out, with the edges of the consecutive plates of the cover then fixed onto the abovementioned brackets. This leads to a high level of instability, with the consequent risk of falling of the plates that have been screwed/welded in a jutting out position and the resultant fall of the materials that have accumulated on them.

At present, to fix certain of these elements, such as support posts, safety cables and lifelines, support pieces in tubular form are used. These are fixed permanently to the structure, allowing the attachment of a specific safety element.

Some examples of this type of device are described in the utility models 200101433 and 200302846, which have support pieces that are fixed permanently to the structure of the construction and that allow the exclusive fixing of safety guards or harnesses.

These devices therefore provide specific solutions to concrete problems during the construction process, but do not provide sufficient versatility to solve the variety of problems that emerge as the work is being carried out and after it is complete, during maintenance and repair work, external cleaning, etc., such as the possibility of fitting safety nets, suspended scaffolding or canopies to protect pedestrians from falling materials or tools.

Specifically in the utility model 200302846, safety guard bars are fixed to a support that partially emerges from the inbuilt support piece, to which it is fixed using an internal bolt.

In this case, the use of inbuilt support pieces can constitute a problem for worker safety, particularly during repair and/or building conservation tasks, as the strength of the mounting of the safety guard bar depends on internal pieces (supports and bolt) the state of preservation of which cannot be checked.

In the case of the utility model 200101433, the safety guard railing is fixed to the inbuilt support piece using an end tooth which is inserted into a cavity to the back of the support and which is immobilised in this position with a "U"-shaped wedge that is also inserted into the support and fixed using an external screw.

In this case, the mounting of the safety guard involves significant risk for the worker, as he or she must go beyond the frame in order to insert the edge of the bar into the front of the support piece and then for the positioning of the wedge and the tightening of the screw. In addition, the safety guard itself is moved towards the edge of the frame, which obviously means that it provides insufficient safety protection.

Other patents describing the closest subject matter provide for a number of more or less complicated features that fail to solve the problem in an efficient and economical way. None of these patents suggest the novel features of the present invention.

SUMMARY OF THE INVENTION

The safety system that is the subject of this invention is of the type that includes a number of support pieces that are tubular in configuration, intended to be fixed permanently to the structure of the construction by incorporating them into the frame and/or by welding them to the metal structure of the frame, leaving one of the openings of these tubular parts accessible.

This safety system has certain specific construction characteristics intended to allow the stable and reliable fixing of different safety devices onto these support pieces, such as safety guard rails, safety cables, safety nets, protective canopies, suspended scaffolding, harnesses or any other safety element required, using interchangeable supports of different configurations for this. A special feature of this invention is that all of the interchangeable supports have the same measurements to allow them to be coupled to the built-in support pieces.

This safety system provides a series of advantages, among which the following should be highlighted: appropriate protection for workers during the installation of the system itself and particularly during the installation of the support pieces that are incorporated into the perimeter area of the frame, allowing one or more safety elements to be mounted on these support pieces using a single interchangeable support, according to the requirements of each case, allowing platforms to be fitted to the perimeter of the frame that enable the comfortable and safe operation of workers and the formation of extendible auxiliary railings for those areas that are a significant distance apart on the horizontal and that are not as a rule covered by the main railings.

Other special features of this system include fixing elements for the interchangeable supports to the inbuilt pieces on the interchangeable supports themselves, which means that their state of preservation can be checked before a support is used and these elements can be substituted and repaired should they have deteriorated. Once one of the interchangeable supports is fixed to one of the support pieces, the retention or blocking elements, consisting of external wedges, remain visible and there is no need for further checking of the tightening of screws or the correct position of the pieces, as the wedge can only be inserted when all of these things are correctly in place.

In accordance with the invention, this system consists of a number of interchangeable supports intended to be fixed temporarily to support pieces that are fixed permanently by incorporation, welding, etc, to the structure of the building. These interchangeable supports provide the mounting means for certain safety devices, such as: safety guard with baseboard and railing, head pieces for lifelines or safety cords for form setters, angled brackets for the upper fastening of safety nets, supports for the lower fastening of safety nets, supports for safety canopy coverings, telescopic supports for the support of scaffolding or tubular structures and supports for platforms.

The abovementioned interchangeable supports are fitted with a fixing device to allow them to be mounted to and retained on the support pieces. This fixing device consists of: a tubular section partially housed in a tubular configuration of the interchangeable supports and two folding retention feet that partially jut out beyond the tubular section at the end of the support and that have two side claws facing in opposite directions jutting out over the front edge.

These feet are mounted at the rear to a common axis associated with the corresponding interchangeable support and which can be turned between an operating position in which the claws jut out to the side over the lengthwise projection of the external tubular section in order to fit onto the corresponding support piece and a non-operative position in which said side claws remain within the space delimited by the lengthwise projection of the external tubular section, allowing them to be freed from the support piece.

The interchangeable supports provide a transverse passage for fitting an extractable wedge that, in the position of use, is hosted in the transverse passage and is positioned between the two retention feet, keeping them in the operating position of fixing the corresponding interchangeable support to one of the support pieces.

The support pieces internally define two side cavities, which are set face to face to house the respective claws of the support piece when in the abovementioned operating position, with the two feet providing double anchoring for the interchangeable support on the support piece. The fitting of the wedge requires the separation of the anchoring feet, which prevents the insertion of the wedge if the feet are not correctly positioned inside the support pieces and prevents the incorrect fixing of the interchangeable supports with respect to the support pieces.

For this invention, the turn axis of the retention feet is mounted on the transverse holes cut out of the interchangeable supports and fixed to this support using nuts that are accessible from the outside, which allows the axis to be dismounted and substituted should it show any sign of deterioration.

The transverse holes for mounting the axis of the retention feet are slightly lengthened in the lengthwise direction of the support, which means that higher fabrication tolerance can be used without reducing the effectiveness of the anchoring. This takes into account the fact that the wedge acts against the front side of the windows mentioned and against the jutting out additions on the internal sides of the retention feet. This ensures, on the one hand, the separation or opening of the retention feet and, on the other hand, the correct mounting of the interchangeable support on the support piece, making all of these parts into a stable and unmovable grouping.

The system has several interchangeable supports, which are fitted with the corresponding fixing device for their coupling to the inbuilt support pieces. These interchangeable supports offer the appropriate configurations for allowing diverse safety elements to be fitted to them, either directly or with the help of intermediate supports.

The protective elements intended to be fixed directly or with the help of intermediate supports are: angled brackets for the upper fastening of safety nets, safety guards with railings, protective canopy coverings.

The intermediate supports allow the attachment of the abovementioned protective elements and other elements, such as suspended loads or tubular structures, to the interchangeable supports.

Additionally, the system consists of a number of positioning bases for fixing the support pieces, which are intended to be incorporated into the frame, so that said support pieces remain static during the pouring of cement. This guarantees their correct positioning, and of auxiliary supports for the mounting of safety guard railings on the formwork boards.

Further objects of the invention will be brought out in the following part of the specification, wherein detailed description is for the purpose of fully disclosing the invention without placing limitations thereon.

BRIEF DESCRIPTION OF THE DRAWINGS

These and other characteristics, which are detailed in the claims, will be more easily understood with the help of the practical example shown in the graphics provided below:

DETAILED DESCRIPTION OF THE EMBODIMENT

Two support pieces (1, 1*a*) can be seen in the figures that are of tubular configuration in a "T" shape. These are intended to be incorporated or fixed definitively to the construction so that the mouth of the central wing remains accessible from the outside in order to allow the coupling of different interchangeable supports (30*a*, 30*b*, 30*c*, 30*d*, 30*e*, and 30*f*).

The support pieces (1*a*) consist of a steel rope or cable (11) intended to remain in a protruding and visible position in order to provide a coupling and permanent fixing point for workers to use, thereby implementing a safety system.

These support pieces (1*a*) also have tubes (12) on the sides to allow them to be fixed to the beams of the frame assembly. These support pieces (1*a*) will preferably be positioned vertically and corresponding with the pillars of the frame.

The support pieces (1 and 1*a*) allow certain interchangeable supports (30*a* through 30*f*) shown in FIGS. 8 to 16 to be coupled and removably mounted to them. Each of said interchangeable supports has a fixing device (4) on one of its ends, to allow it to be immobilised on the support pieces (1, 1*a*).

Figure 1:
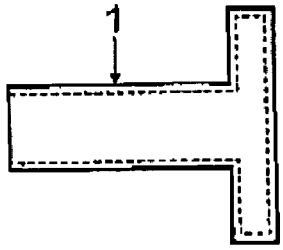
FIG. 1 shows an overhead plan view of the support piece (1).
Figure 2:
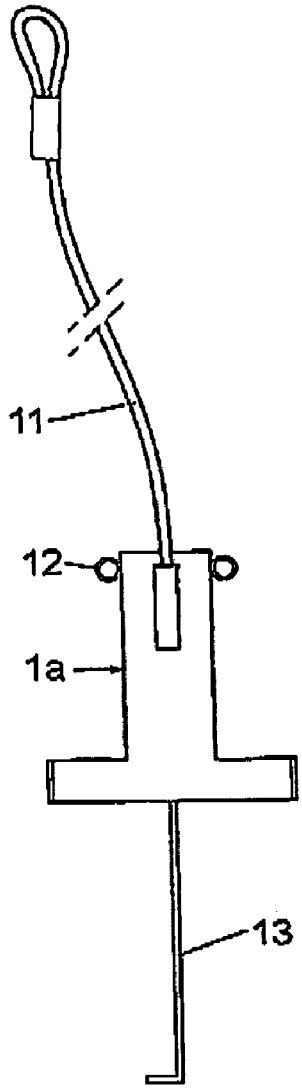
FIG. 2 shows an elevation view of the support piece (1*a*).
Figure 3:
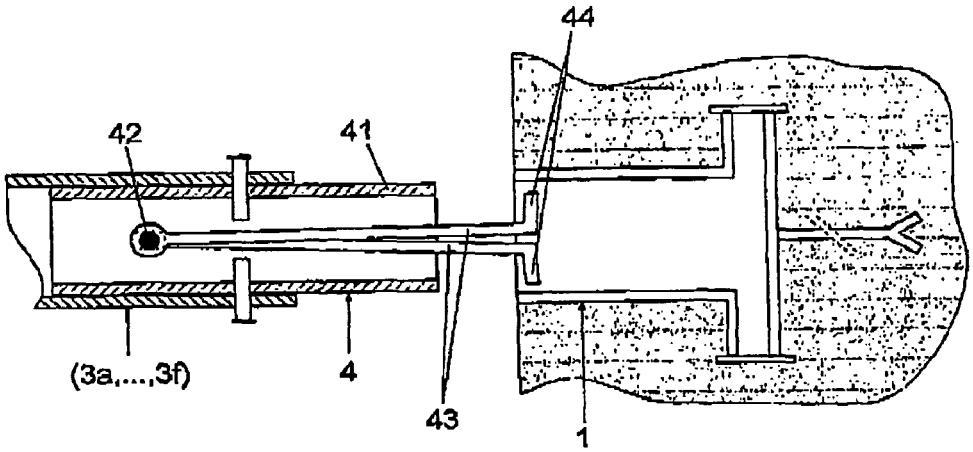
FIG. 3 shows a partial cross-sectional view of support piece (1) aligned with fixing device (4) for any of the interchangeable supports.
Figure 4:
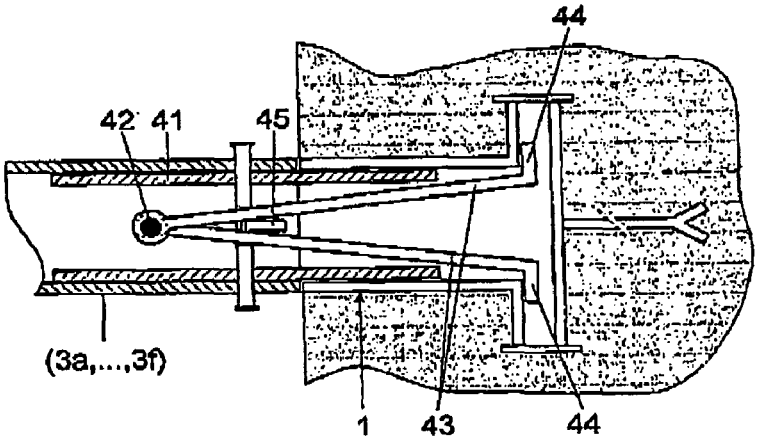
FIG. 4 shows the same view as above with fixing device (4) anchored to support piece (1).
Figure 5:
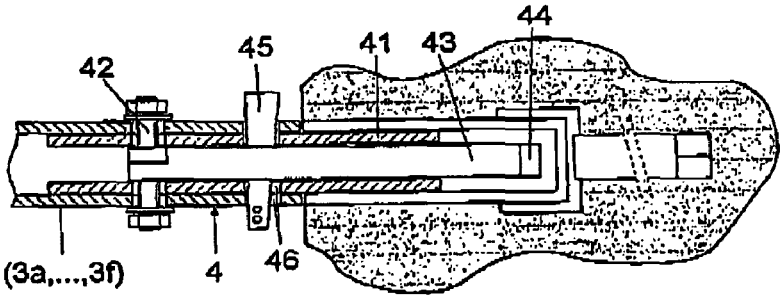
FIG. 5 shows another longitudinal cross-sectional view of support piece (1) with fixing device (4) engaged to each other.

As can be seen in FIGS. 3, 4 and 5, fixing device (4) comprises: an external tubular section (41) that can be coupled internally to the support pieces (1, 1*a*) and two retention feet (43) which at the front end have two side claws (44) facing opposite directions. These retention feet (43) are mounted at the rear end on a common axis (42), which can be turned between: an operating position in which the claws (44) jut out to the side over the lengthwise projection of the external tubular section (41) to in order to fit onto the corresponding support piece (1) and a non-operative position in which said side claws (44) remain within the space delimited by the lengthwise projection of the external tubular section (41), allowing them to be freed from the support piece (1). The feet (43) are immobilised in the open or anchoring position by a wedge (45) that is inserted into a transverse passage (46) to remain in position between the two retention feet (4).

Figure 6:
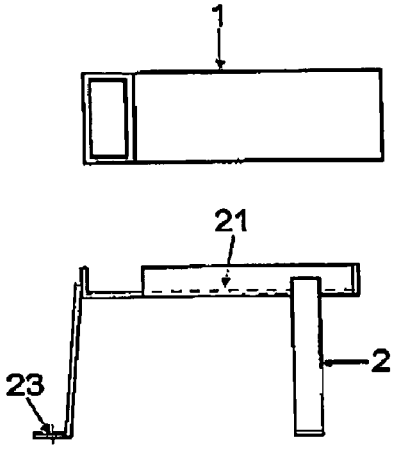
FIG. 6 shows a section view of a positioning base (2) and of one of the support pieces distanced vertically from said positioning base.
Figure 7:
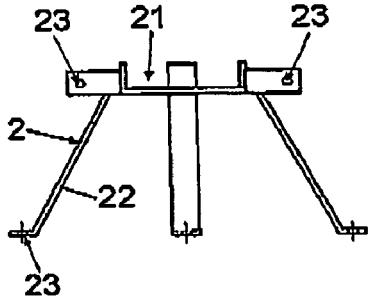
FIG. 7 shows a front view of the positioning base (2) for support pieces.

To fix the support pieces (1) in a horizontal position with respect to the formwork, prior to pouring in the cement that will provide the frame, this invention consists of a number of positioning bases (2) shown respectively in elevation and section plan in FIGS. 6 and 7.

The tops of these positioning bases (2) define the routing (21) for the stable, horizontal support of the support pieces (1) and support feet (22). Both the routing (21) and the feet (22) have holes (23) to allow the mounting of fixing elements such as nails, screws or similar.

Figure 8:
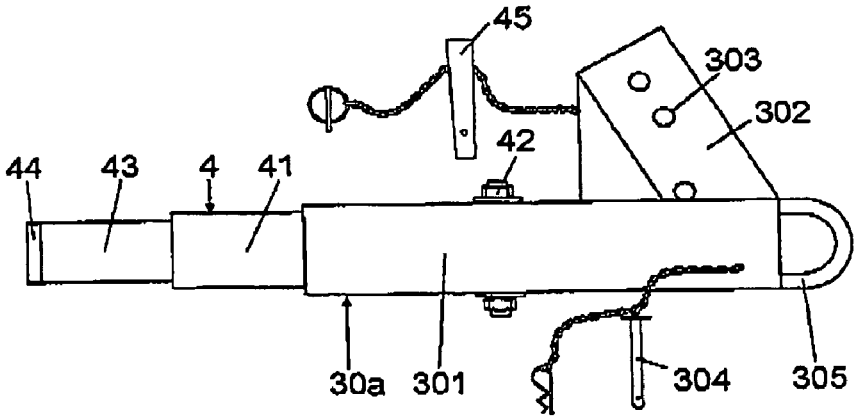
FIG. 8 shows an elevation view of the interchangeable support (30*a*).

The interchangeable support (30*a*), shown in FIG. 8, has a straight tubular section (301) which has a number of elements fixed to it: at one end is the corresponding fixing device (4), to the top is a diagonal tubular section (302) for coupling various protective elements and at the front end, a ring (305) for anchoring cables, tensioners or similar elements.

In the assembly position of the interchangeable support (30*a*) on the support pieces (1, 1*a*), the diagonal tubular section (302) is facing the frame, which allows the worker to have easy access to it from the frame, reducing the risk of falling accidents. This tubular section (302) has a number of transverse holes (303) for the retention of the protective element coupled to it with a pin (304).

This interchangeable support (30*a*) is used for fixing intermediate supports (FIG. 18) and cables or straps (FIG. 23), as will be explained below.

Figure 9:
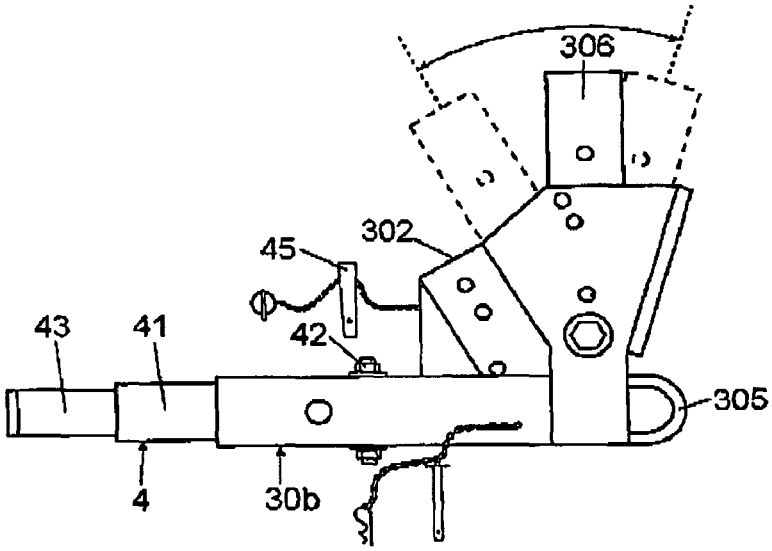
FIG. 9 shows an elevation view of the interchangeable support (30*b*).
Figure 10:
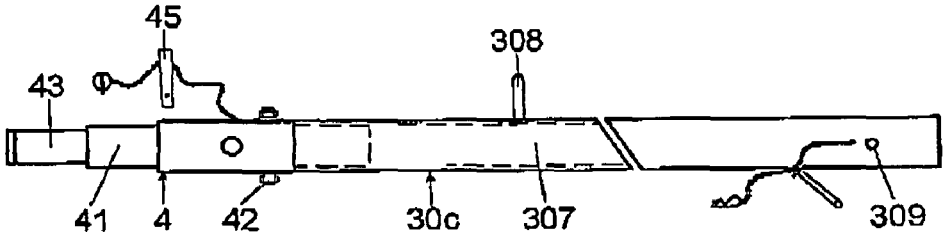
FIG. 10 shows an elevation view of the interchangeable support (30*c*).
Figure 11:
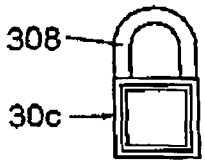
FIG. 11 shows a section view of the interchangeable support (30*c*).
Figure 25:
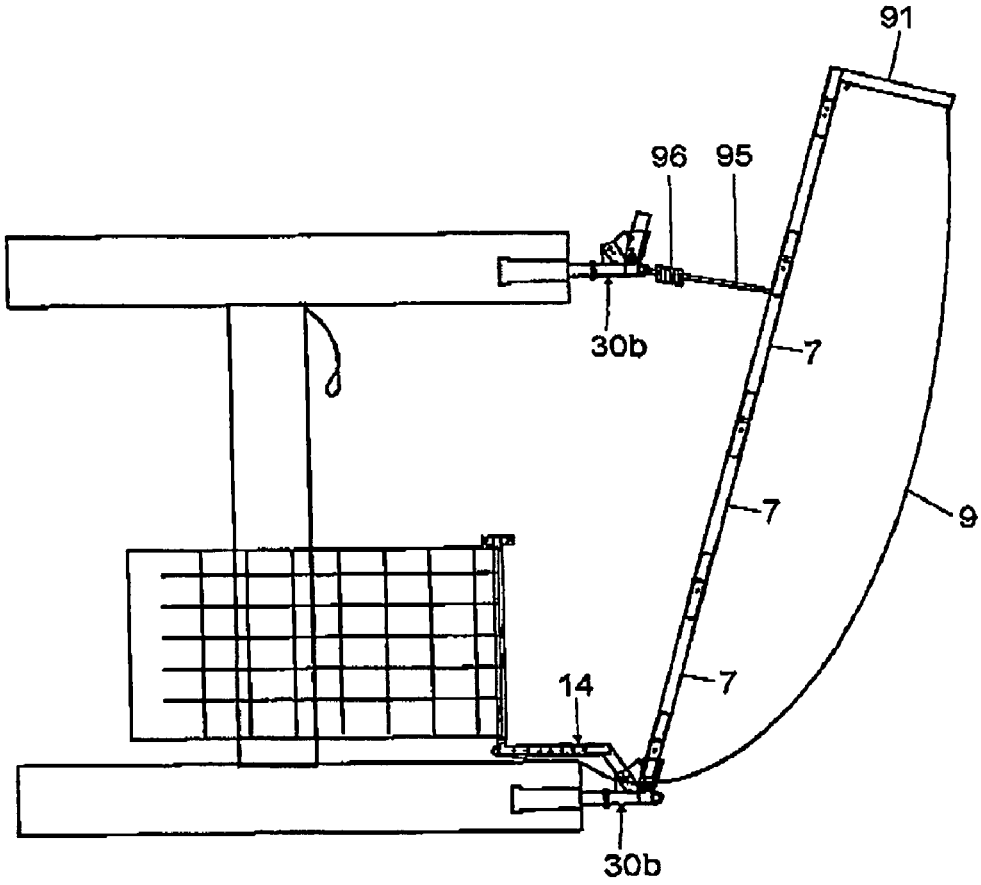
FIG. 25 shows a detail of the attachment of the angled bracket during works, fitted onto one of the interchangeable supports (30*b*) and fixed from above by a strap with a central elastic portion, to another interchangeable support (30*b*).

The interchangeable support (30*b*), shown in FIG. 9, is configured in a similar way to the interchangeable support (30*a*) and also has a tubular section with a tipping motion (306) on the upper section for coupling angled brackets for the attachment of the safety net (FIG. 25).

The possibility to tip the tubular section (306) allows it to be positioned towards the frame so that a safety element can easily be coupled to it, such as an angled bracket for attaching safety nets, and to then be tipped towards the exterior of the frame, so that the angled bracket remains tilted towards the exterior, jutting out beyond the frame.

Figure 35:
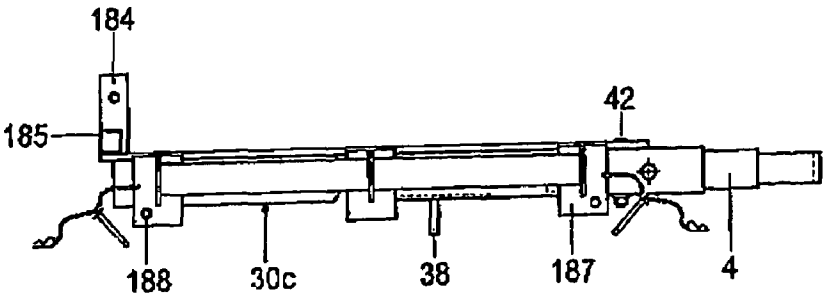
FIG. 35 shows an elevation view of the intermediate support (18) mounted on an interchangeable support 30*c*.
Figure 36:
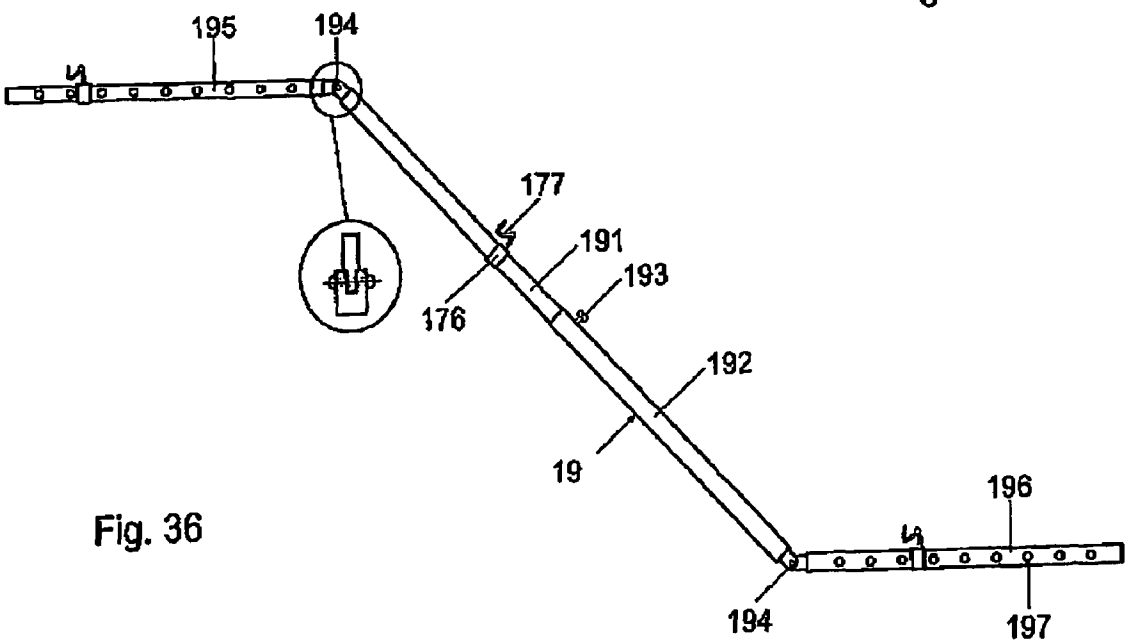
FIG. 36 shows an elevation view of an auxiliary railing (19) used to join railings arranged on different horizontal planes.

The interchangeable support (30*c*) consists of a straight tubular section (307), which is composed of: at one end, the corresponding fixing device (4); in the intermediate zone, a side ring (308) and at the front end, a transverse hole (309) for the retention of additional parts using the corresponding pin. This is used for the attachment of protective canopies (FIG. 22) and of supports for platforms (FIG. 35).

Figure 12:
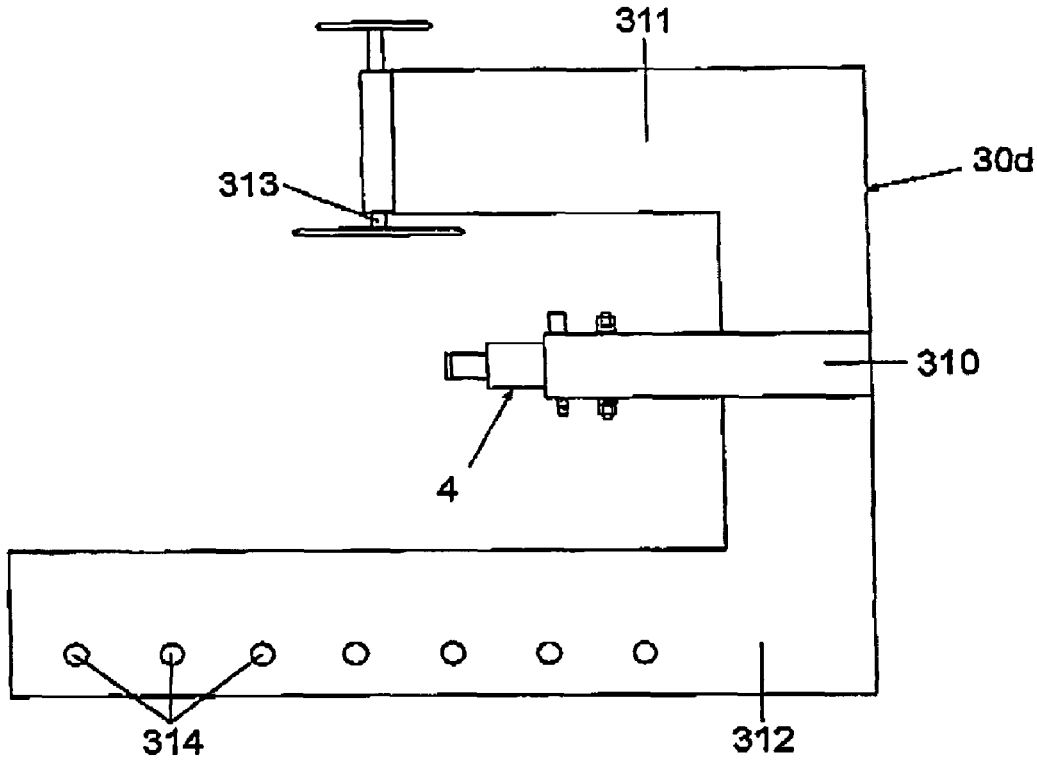
FIG. 12 shows an elevation view of the interchangeable support (30*d*).

The interchangeable support (30*d*), represented in FIG. 12, is intended to support extremely heavyweight suspended loads in overhanging frames and consists of a straight tubular section (310) that has the corresponding fixing device (4) at one end and on the other end has an upper arm (311) and a lower arm (312), with a noticeable "L" shape cross section, intended to be positioned parallel above and below a floor of the frame. The upper arm (311) of the interchangeable support (30*d*) has a foot (313), which is adjustable in height, to fix it on the frame, while the lower arm (312) has a row of transverse holes (314) for fixing suspended loads such as suspended scaffolding, harnesses, hoists or similar.

Figure 13:
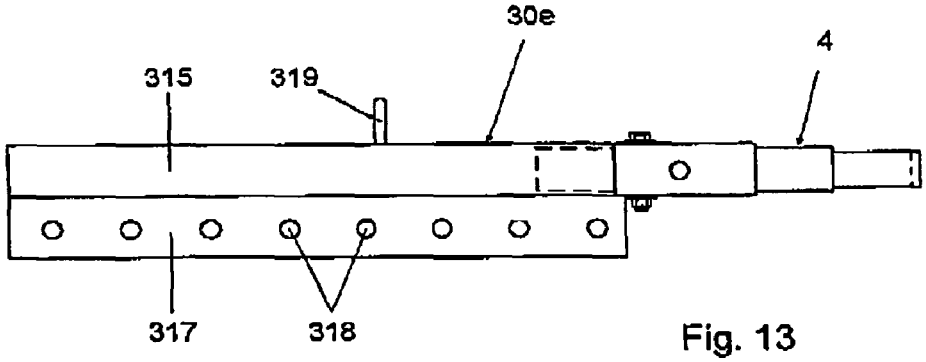
FIG. 13 shows an elevation view of the interchangeable support (30*e*).
Figure 14:
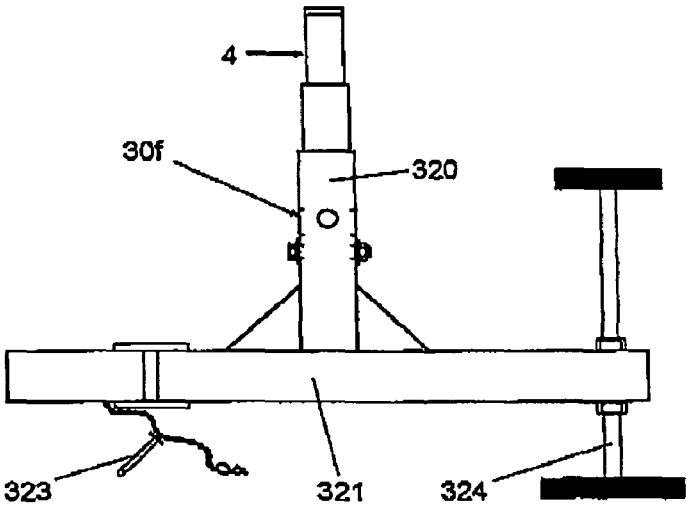
FIG. 14 shows an elevation view of the interchangeable support (30*f*).
Figure 15:
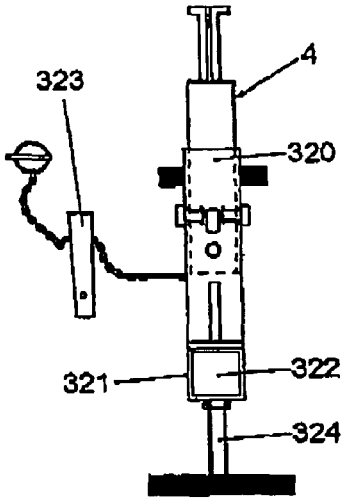
FIG. 15 shows a side view of the interchangeable support (30*f*).
Figure 16:
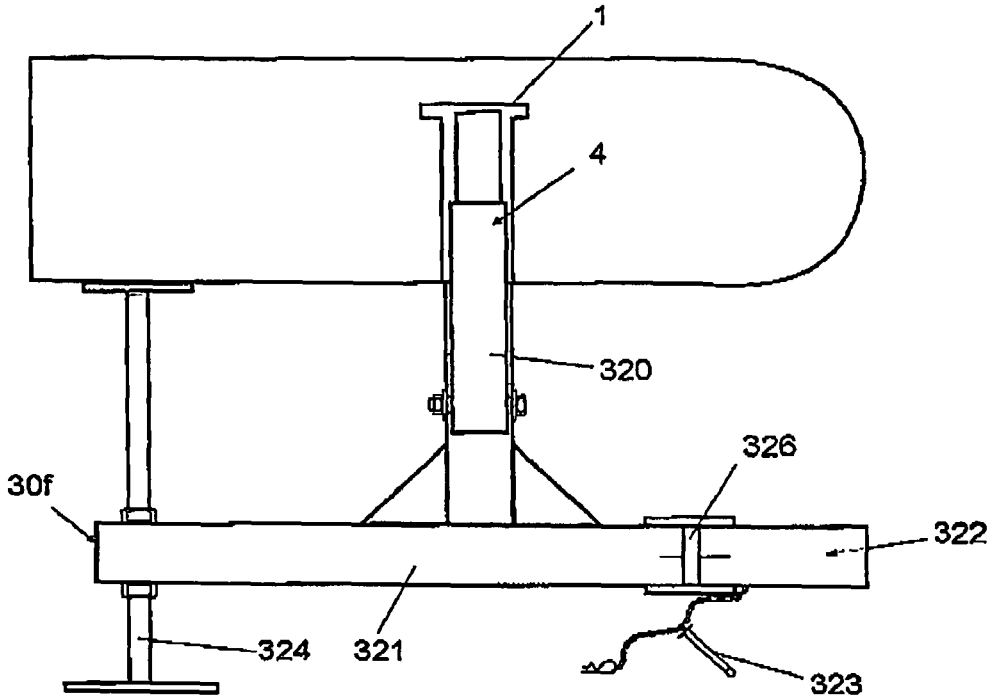
FIG. 16 shows an elevation schematic diagram of the attachment of the interchangeable support (30*f*) to a support piece that is vertically inbuilt into a frame, facing the zone below.
Figure 16A:
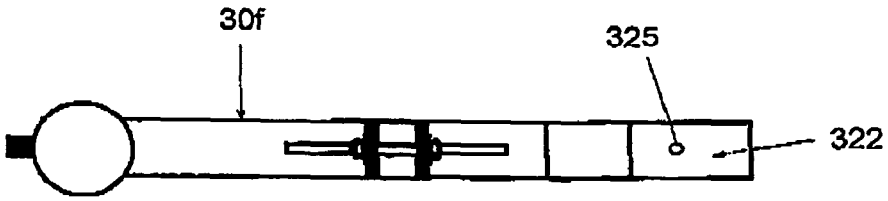
FIG. 16*a* shows an overhead plan view of the interchangeable support (30*f*).

The interchangeable support (30*e*), represented in the FIG. 13), allows the overhanging attachment of suspended loads. This interchangeable support (30*e*) consists of a straight tubular section (315) which has the corresponding fixing device (4) at one end and to the side has a lower plate (317) with a row of transverse holes (318) for hooking on suspended loads and an upper ring (319) for fixing support cables or straps.

The interchangeable support (30*f*) shown in FIGS. 14, 15, 16 and 16*a*, is fixed onto an element (1) that is incorporated into the lower surface of the frame. This support is used mainly in those cases where the frame has a decorative front, which will not allow the positioning of the element (1) in the horizontal position on this front of the frame.

The interchangeable support (30*f*) is of tubular configuration in the shape of an inverted "T", with the corresponding fixing device (4) for coupling to the piece (1) on the upper edge of the central tubular section (320).

The horizontal tubular section (321) has an opening (322) at one end for the optional coupling of a fixing device (4), with the claws (44) going through slots (326), or of a tongued and grooved supplement. In all cases, these elements are attached by a pin (323) that is mounted on the hole (325). The tubular section (321) has a height-adjustable support foot (324) on the opposite edge, intended to be supported by the lower surface of the frame, as shown in the FIG. 16), to provide greater stability and prevent sideways rocking.

Figure 17:
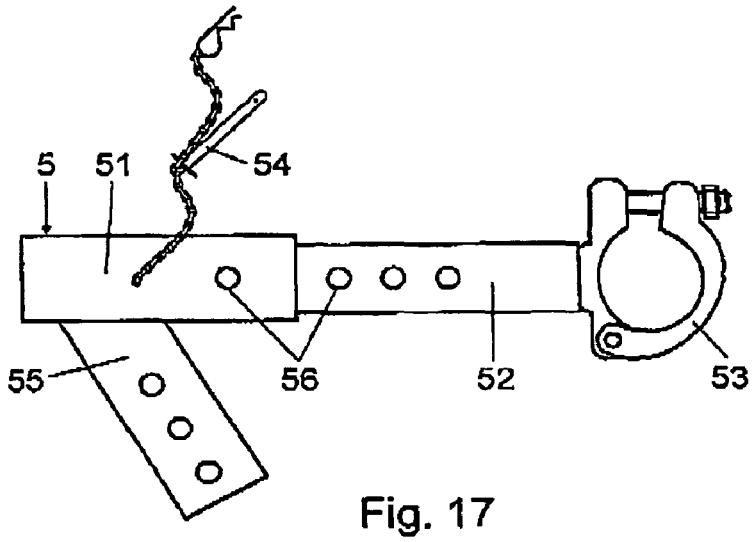
FIG. 17 shows a section view of a telescopic intermediate support (5) for the fixing of scaffolding or tubular structures.
Figure 18:
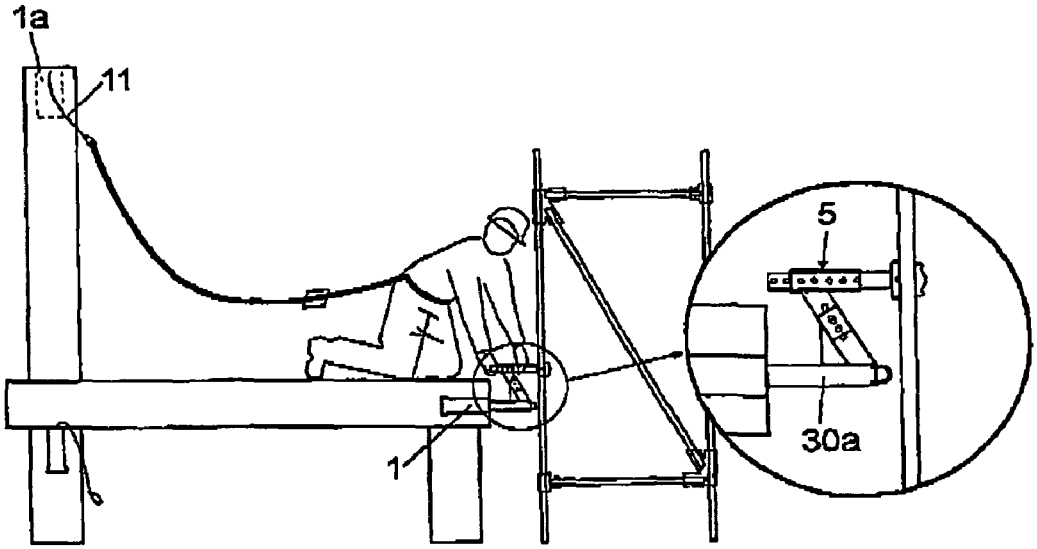
FIG. 18 shows an explanatory detail of the fixing of the telescopic support (5) supporting scaffolding.

As can be seen in FIGS. 17 and 18, the safety system incorporates a number of intermediate telescopic supports (5) for attaching scaffolding or auxiliary structures. This telescopic support (5) can be coupled to the diagonal tubular section of the interchangeable support (30*a*).

The abovementioned intermediate telescopic support (5) consists of a tubular section (51) on which a tubular prolongation (52) is fitted telescopically, the latter ending in a pressure brace (53). As shown in FIG. 18, this telescopic support (5) enables scaffolding or any similar tubular structure to be firmly attached using the brace (53).

The tubular section (51) and the tubular prolongation (52) have holes positioned along them transversally (53) to allow them to be fixed in different relative positions using a pin (54).

The tubular section (51) has a diagonal tubular addition (55) which is intended for coupling to the support (30*a*), fixing it in the desired position using the corresponding fixing pin.

The intermediate telescopic support (5) can be positioned on the interchangeable support (30*a*) by the worker with total safety, as he or she will be attached to the rope (11) of one of the support pieces (1*a*), as shown in the diagram in FIG. 18.

Figure 19:
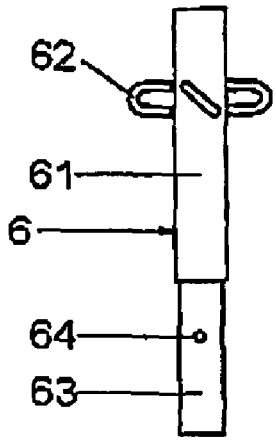
FIGS. 19 and 20 show elevation views of routing and the plan view of a head piece (6) for the attachment of lifelines or safety cables.
Figure 20:
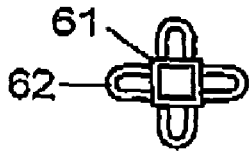

FIGS. 19 and 20 show elevation and overhead plan views of the head piece (6) of a lifeline that consists of a tubular section (61) with a number of rings (62) in the sides for fastening safety cables or lifelines for form setters.

Figure 21:
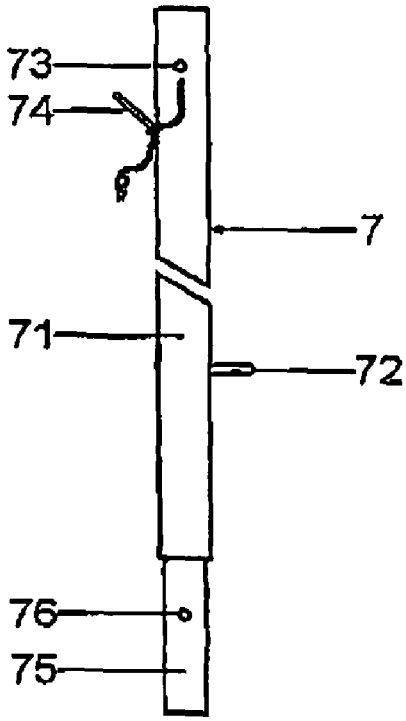
FIG. 21 shows an elevation view of a supplement (7) applicable to the configuration of variable length masts.

The tubular section (61) is prolonged at one end by a tubular addition (63) that allows this head piece (6) to be attached, either directly onto one of the interchangeable supports (30*c*) or through a modular mast, based on successive supplements (7), as shown in FIG. 21. The tubular addition (63) of the head piece (6) has a transverse hole (64) so that it can be retained in the assembly position by means of a pin.

The supplements (7) allow masts of different lengths to be made for different purposes by the addition of successive pieces, as will be described below. One of these purposes is as an attachment point for the head piece (6) for lifelines.

These supplements (7) consist of a tubular section (71), which has a ring (72) on the side for fixing attachment elements or tensioners.

The abovementioned tubular section (71) has a transverse hole (73) at one end for fixing several successive supplements (7) in the coupling position using a pin (74) or for fixing other parts such as the head piece (6) for lifelines.

This tubular section (71) has a tubular prolongation (74) of a smaller diameter on the other end for coupling to the interchangeable supports (30*a* through 30*f*) or to another similar supplement (7), while the tubular prolongation (75) has a transverse hole (76) for holding it in the assembly position using a pin or similar.

The supplements (7) allow, as mentioned above, the conformation of modular masts of variable lengths which are applicable both for the angled brackets for attaching safety nets and in supporting the head pieces (6), or in the conformation of supports for protective canopy coverings.

Figure 22:
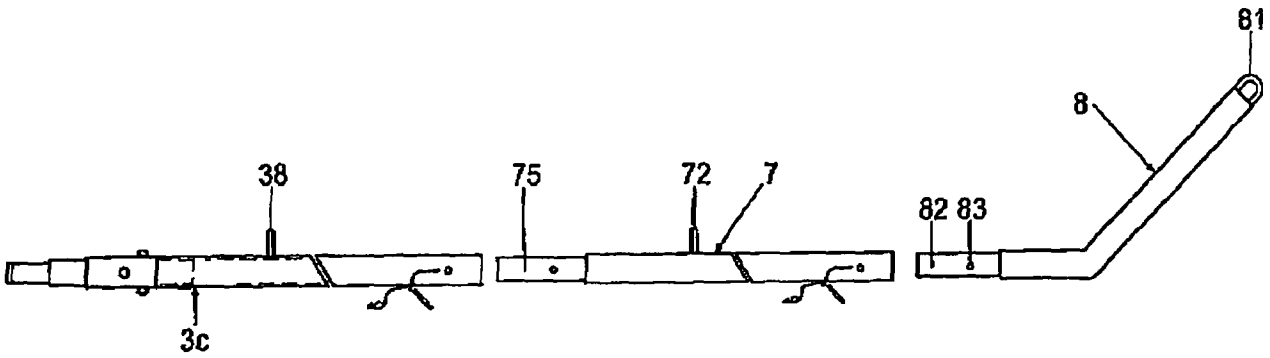
FIG. 22 shows an exploded elevation view of an example of manufacturing a support for protective canopy coverings.
Figure 22B:
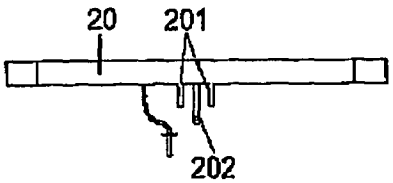
FIG. 22*b* shows an elevation view of some of the pieces for supporting the covering of the canopy, shown in the previous figure.
Figure 22A:
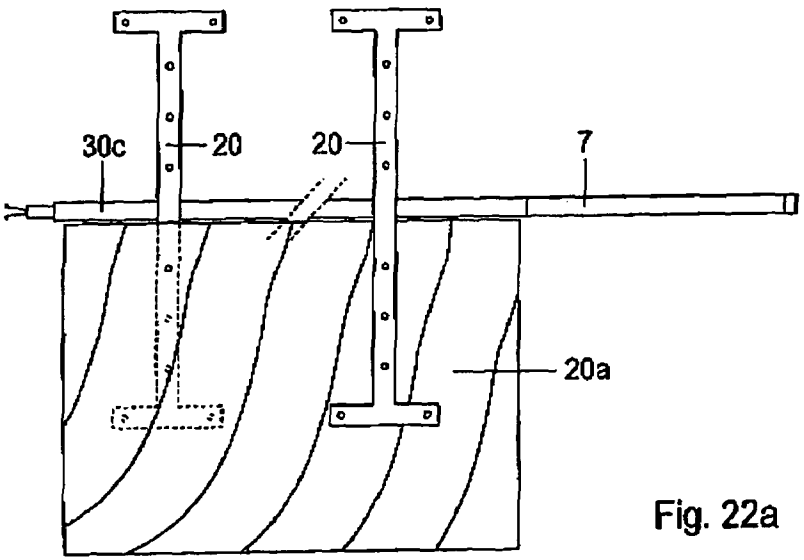
FIG. 22*a* shows an overhead plan view of parts for supporting the covering of a protective canopy, positioning them on the support of the figure above.

Specifically, FIG. 22 shows a support for protective canopy coverings, consisting of an interchangeable support (30*c*) intended to be anchored to one of the support pieces (1) incorporated into the frame, a supplement (7) and a bent tubular end piece (8), which has a ring (81) at the front end and a tubular addition (82) at the back end for tongue and grooved coupling to other parts, and a hole (83) for the attachment of a retention pin.

Figure 23:
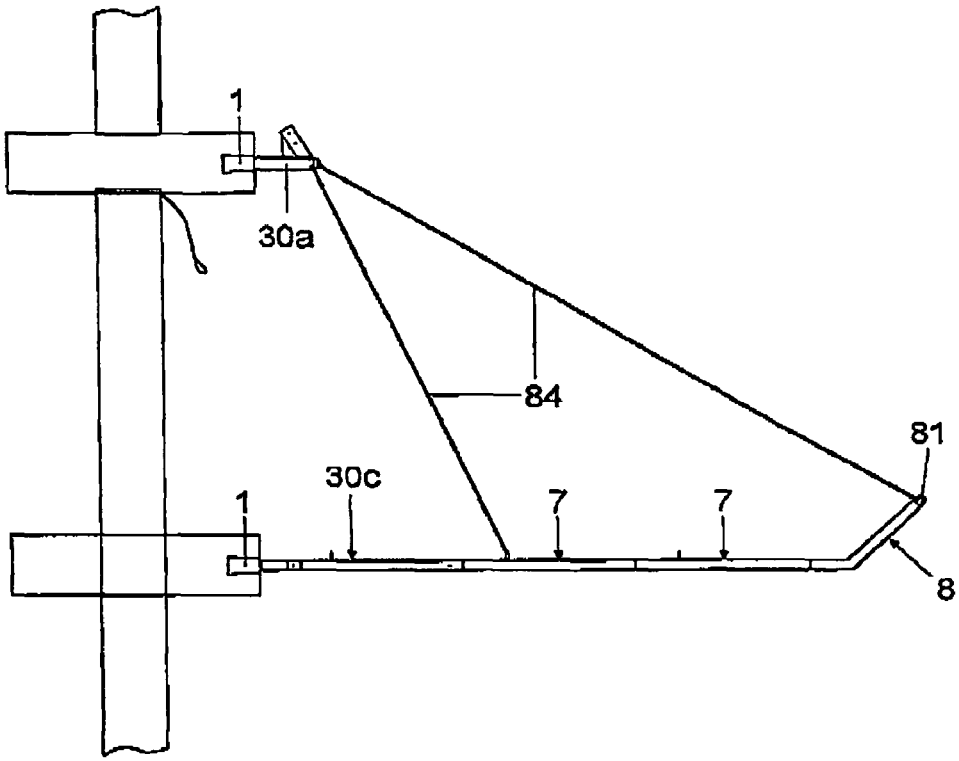
FIG. 23 shows a detail of the attachment of the support for protective canopy coverings, fixed with cables or straps.

This modular configuration means that it is possible to obtain supports for canopies of varying lengths, reinforcing support strength using support cables or straps (84) that can be fixed at one end to the rings in the pieces (7 and 8) and at the other end to the end ring of one of the interchangeable supports (30*a* or 30*b*), fixed to the upper floor of the frame with the corresponding support piece (1) as shown in FIG. 23.

The covering of the protective canopies is complemented with a number of tubular parts (20), configured in the form of an "H", intended to support the extremes of the canopy surface plates (20*a*). The abovementioned tubular pieces (20) have on their lower side, in the middle, two parallel fins (201) that laterally embrace the support (30*c*) or the supplements (7) that make up the canopy support, and an intermediate tip (202) that is housed in the transverse holes cut into said pieces to this effect, with the pieces (20) fixed in the assembly position by a pin that passes through a hole cut out of said tip (54).

Figure 24:
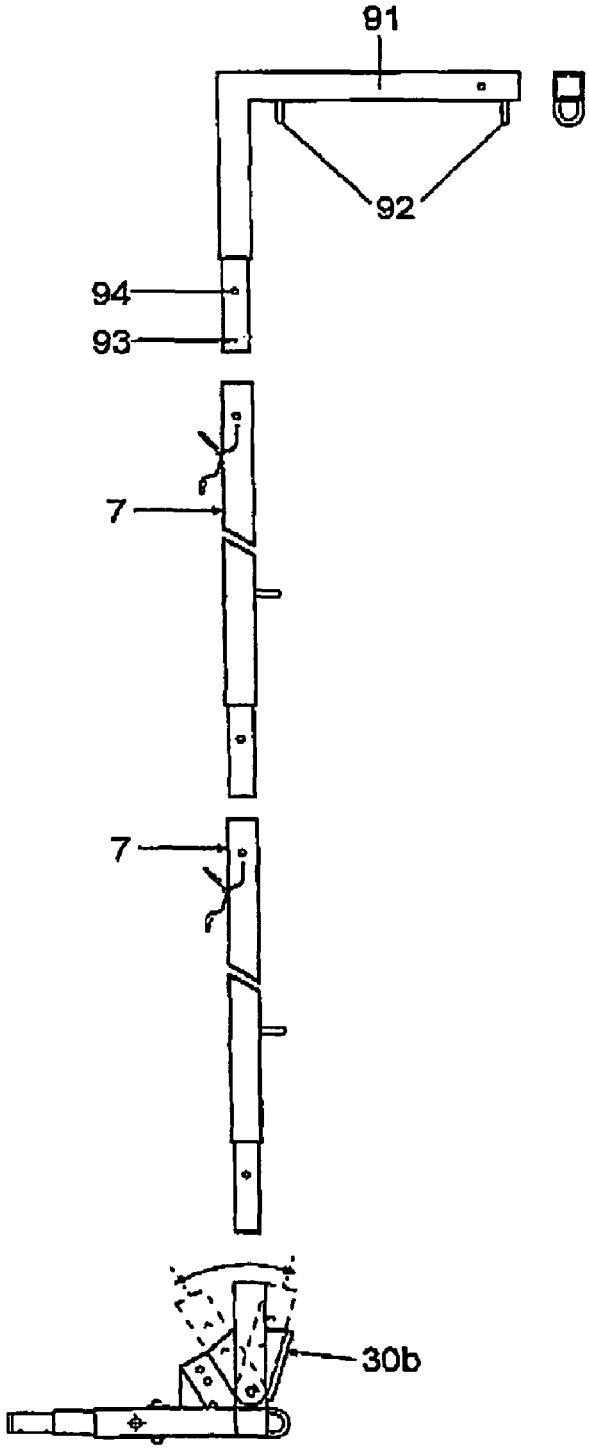
FIG. 24 shows an exploded elevation view of an angled bracket for supporting safety nets aligned with an interchangeable support (30*b*).

As shown in FIGS. 24 and 25, the angled brackets for attaching safety nets (9) consist of a mast, the length of which can be regulated by the coupling of successive supplements (7) and an end tubular piece (91), generally configured in an "L" shape, which forms part of the angled bracket itself.

This tubular piece (91) has a number of lower rings (92) on its wing or end section for the sliding passage of an attachment cord for the net (9). The lower end of the tubular piece (91) has a tubular prolongation (93) that is smaller in diameter and that is furnished with a transverse hole (94) for the coupling and fixing of the upper supplement (7) of the mast, using a pin.

The angled bracket is mounted on the foldable tubular piece of a support (30*b*) to facilitate its convenient mounting from the frame and to allow the later inclination of the angled bracket towards the exterior.

The side rings of the supplements (7) of the mast allow, in this case, the mast to be fixed to the end ring of the interchangeable support (30*b*) mounted on the upper floor of the frame using attachment elements (95) that consist of an elastic portion (96) to dampen any possible impact received by a worker should they fall onto the element supporting the safety net (9).

Figure 26:
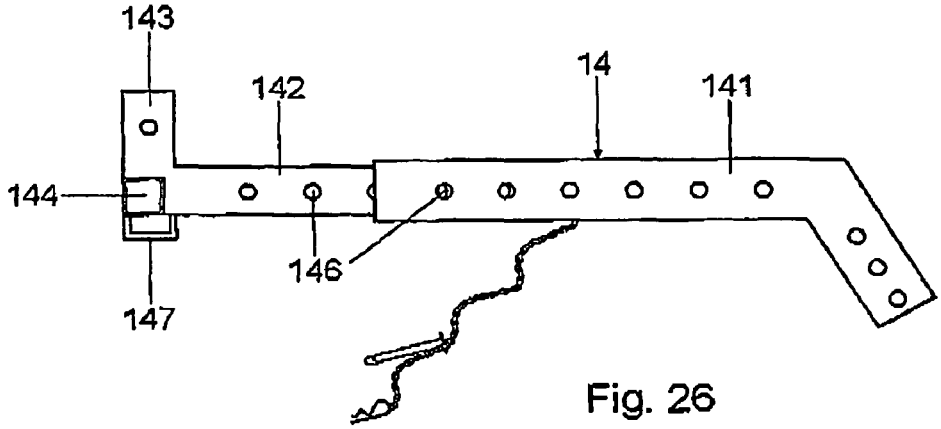
FIGS. 26 and 27 show elevation and section views respectively of an intermediate support (14) used in the fixing of safety masts, baseboards and safety nets.
Figure 27:
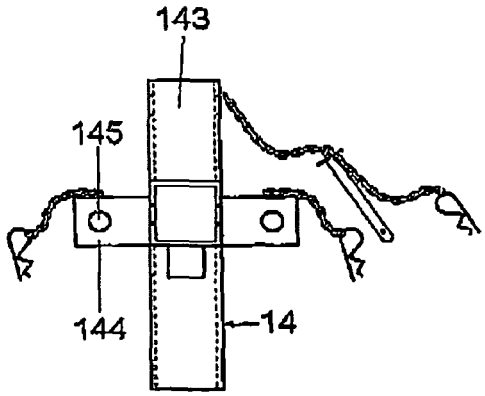
Figure 28:
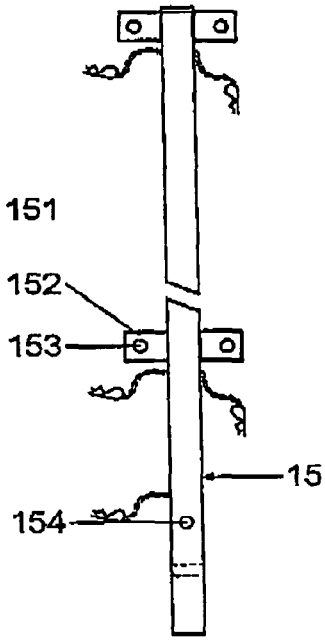
FIG. 28 shows a section view of a safety guard mast (15).

To attach the lower edge of the net and the support of the safety guards, the system has intermediate supports (14). One of these supports can be seen in elevation and in section plans in FIGS. 26 and 27.

This intermediate support (14) has an angled tubular section (141), intended for fixing on one of the interchangeable supports (30*a* or 30*b*), as shown in FIG. 25. A tubular prolongation (142) is mounted telescopically on the tubular section (141). The end of this prolongation folds towards the upper zone in a tubular section (143) for the coupling of a safety guard mast (15), as shown in FIG. 29.

Figure 29:
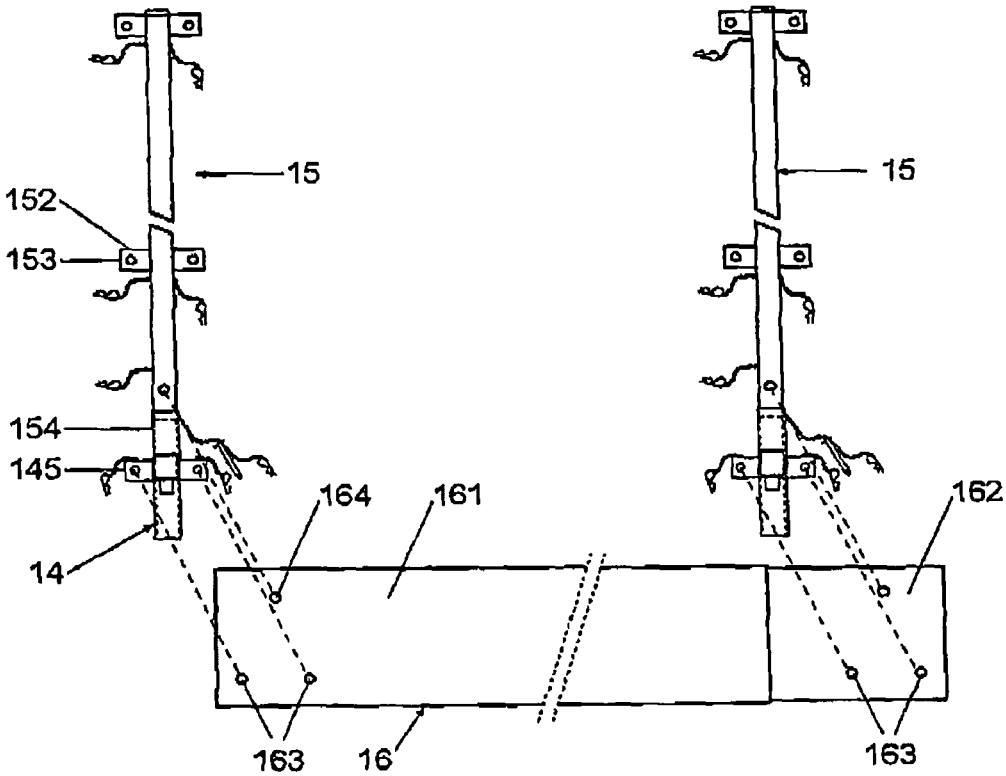
FIG. 29 shows an explanatory detail of the mounting of the safety guard mast (15) on the intermediate supports (14) and of the mounting of a telescopic baseboard (16) on these masts.
Figure 30:
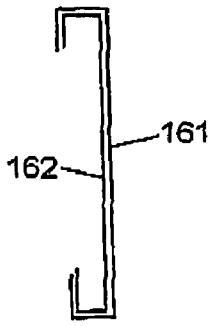
FIG. 30 shows a profile view of the telescopic baseboard (16).

The abovementioned tubular prolongation (142) has a number of side additions (144) at the end, also tubular, which have holes (145) for the optional mounting of an extendible baseboard (16) represented in FIGS. 29 and 30.

The support (14) has on the lower side of the end of the tubular prolongation (142) a ring (147) for the attachment or sewing of the lower edge of the net using a cable, as shown in FIG. 25.

Both the tubular section (141) and the tubular prolongation (142) of the supports (14) are equipped with transverse holes (146) so that they can be fixed in the assembly position by a retention pin.

The safety guard mast (15) consists of a tubular post (151) that can be coupled to the support (14) and with crosspieces (152) at different heights with transverse holes (153) for mounting telescopic railings (17).

The tubular post of the safety guard mast (15) also has a hole (154) close to its lower zone for the attachment of the baseboard (16) as shown in FIG. 29.

As shown in FIG. 30, the abovementioned baseboard (16) consists of a pair of plates (161 and 162) of a general "C" configuration and with similar sections, to be mounted lengthwise with the possibility of relative movement.

The plates making up the baseboard (16) have two lower holes (163) at their ends, intended to allow them to be fixed to the holes (145) in the support (14) and an upper hole (164) for them to be fixed using a pin or similar to the hole (154) of the safety guard masts (15).

Figure 31:
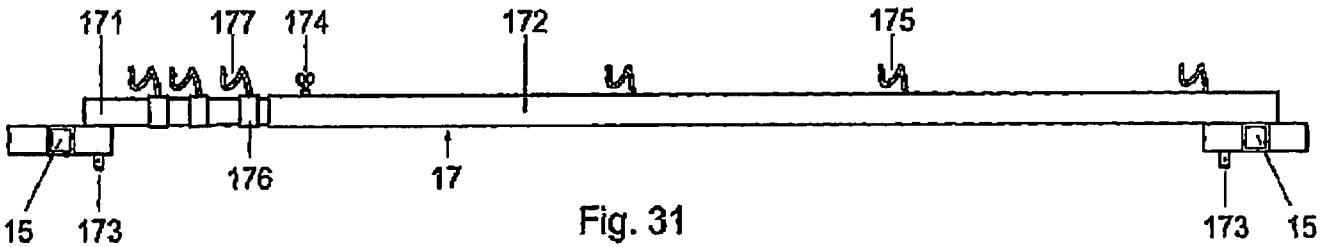
FIG. 31 shows a plan view of an extendible railing (17), with hooks for a safety net to be fitted, mounted on two safety guard masts (15).

The telescopic railing (17), represented in FIG. 31 and intended for coupling to the safety guard masts (15), consists of a male section (171) mounted telescopically to a female section (172). Both sections have side tips (173) at the opposite ends for mounting on the holes (153) of the safety guard masts (15).

The male section (171) is fixed in the desired position with respect to the female section (172) using a jackscrew (174) radially mounted on the female section in question (172).

The railing (17) may have hooks (175, 177) for fixing a safety net. Specifically, in the example shown in FIG. 31, the female section (172) has hooks (175) attached by welding, while additional hooks (177) for the retention of the net are mounted on the male section (172) by moveable sleeves (176).

Figure 33:
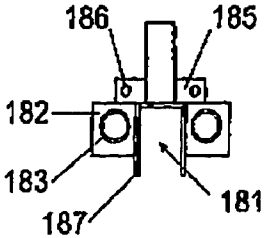
FIGS. 32, 33 and 34 show elevation, section and plan views of passages of an intermediate support (18) for the support of platforms.
Figure 32:
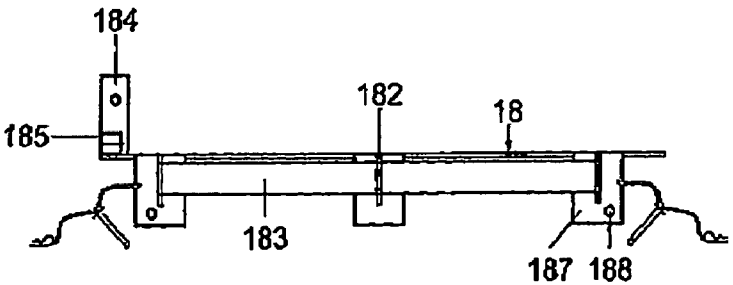
Figure 34:
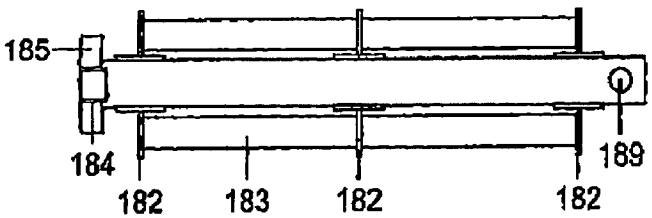

The system of the invention consists of intermediate supports (18) for platforms, with one of these supports represented in elevation, section and overhead plan views in the FIGS. 32, 33 and 34 respectively.

These intermediate supports (18) have a lengthwise inverted "U"-shaped section outlining a lower routing (181) for their mounting and horizontal support on one of the interchangeable supports (30*c*), as shown in FIG. 35.

The intermediate supports (18) have side fins (182) on which the horizontal tubes (183) providing the stable support for the platforms usually used for scaffolding fit in place and are fixed definitively. These tubes have two end support hooks.

The abovementioned intermediate supports (18) have a tubular section (184) on their upper front end for mounting the corresponding safety guard mast (15) which will allow, as shown in FIG. 31, the fixing of telescopic protective railings (17).

The supports (18) have side crossbeams (185) on their front end, which have holes (186) for the optional mounting of a baseboard (16), together with the safety guard mast (15).

The supports (18) consist of a number of side shims (187) with holes (188) for mounting the pins that embrace the support from below (30*c*), preventing the abovementioned support (18) from lifting.

To prevent the lengthwise movement of the support (18) with respect to the interchangeable support (30*c*), the upper side of said support (18) is lengthened towards the rear zone, where there is a hole (189) that receives the head of the screw (42) responsible for the attachment of the corresponding fixing device (4) to the support (30*c*).

The system of the invention consists additionally of a number of auxiliary railings, represented in FIG. 18, which consist of two telescopically mounted tubular sections (191 and 192), which are fixed to each other by a jackscrew (193).

These tubular sections (191 and 192) have the corresponding joints on the opposite ends for the folding assembly on the respective tubular pieces (195, 196).

These tubular pieces (195, 196) are coupled to the ends of the main railings in order to cover those zones that are far removed on the horizontal plane, such as balconies. The tubular pieces (195, 196) have transverse holes (197) to hold them in the assembly position with pins.

Figure 37:
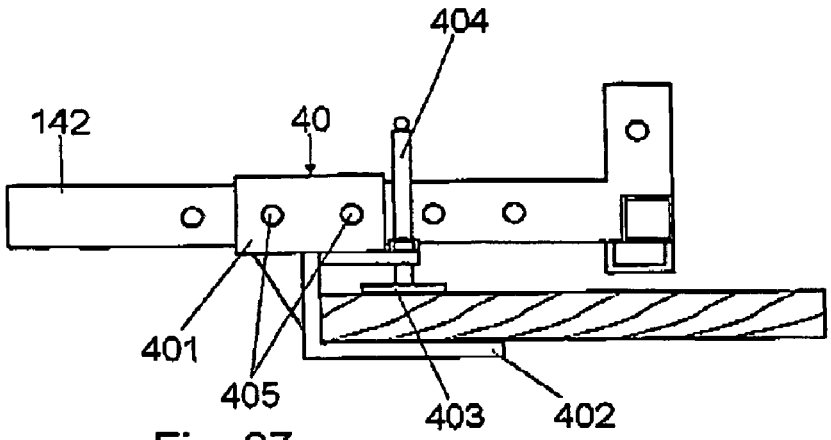
FIGS. 37 and 38 show elevation and section views of an auxiliary support for mounting safety guard rails, fixed to a formwork board.
Figure 38:
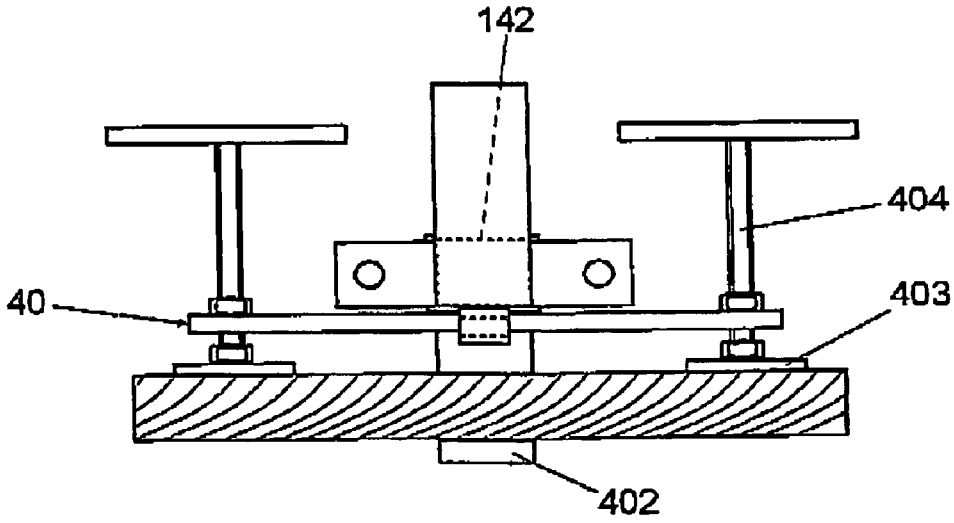

FIGS. 37 and 38 show one of the auxiliary supports (40) used for mounting safety guard railings on the formwork board, with the possibility to see this device fixed to a formwork board. The auxiliary support (40) consists of a tubular piece (401) with a pressure clamp for fixing it onto a formwork board. This clamp consists of a lower claw (402) and upper clamp plates (403), which are associated with operating screws (404). The lower claw (402) can be fixed to the tubular piece (401) by a fixed length vertical wing, as shown in the figures attached, or using a telescopic vertical wing to allow the mounting of the vertical auxiliary support (40) on boards of very different thicknesses.

The same tubular prolongation (142) used in the intermediate support (14) can be mounted onto the tubular piece (401) with the possibility of lengthwise movement, for the attachment of safety guard railings. This tubular piece has a transverse hole (405) for the attachment of the tubular prolongation (142) in the desired position, using the corresponding pin. The abovementioned tubular prolongation (142), which is the same as the one shown in FIG. 26, allows a safety guard, consisting of the mast (15), the railings (17) and the baseboard (16) to be mounted on the support (40).

Now that the nature of the invention has been described, along with an example of its preferred embodiment, it should be stated for all intents and purposes that the materials, form, size and positioning of the elements described may be modified, provided that this does not involve any alteration to the essential characteristics of the invention for which the claims are laid out below.

What is claimed is:

1. A safety system for building structures, comprising:

A) a support piece mounted to a fixed location of a building structure, said piece having a T-shaped tubular member having a first tubular member connected with a crossing second tubular member, and said first tubular member including an opening that is exteriorly exposed; and B) an interchangeable support member having first and second ends, said first end including a coaxially mounted fixing device (4) removably mounted to said first tubular member through said opening, said fixing device including a tubular section (41) having two retention feet (43) extending from a common axis (42) and each having a claw (44) at their respective distal ends that are removably lodged within said second tubular members for a locking engagement thereto and further including a wedge member (45) to keep said retention feet (43) in place, and upon the removal of said wedge member (45) said retention feet are dislodged from said second tubular member.

2. A system, according to claim 1, that is characterised in that the support piece includes two side cavities which are set face to face to house the respective claws (44) of the fixing devices (4) of the interchangeable supports.

3. A system, according to claim 1, that is characterised in that the modular masts consist of successive supplements (7) that consist of a tubular section (71) which has a side ring (72) for fixing cables or tensioners, while said supplements (7) have at one end a tubular prolongation (75) for coupling, with a transverse hole (76) and at the opposite end, a transverse hole (73) for mounting a retention pin (74).

4. A system, according to claim 1, that is characterised in that the angled brackets for attaching safety nets (9) consist of: a modular mast consisting of at least one supplement (7) and an end tubular piece (91), generally configured in an "L" shape, which has a number of lower rings (92) for the sliding passage of an attachment cord for the net (9) and a tubular prolongation (93) that is smaller in diameter and that can be coupled to said modular mast.

5. A system, according to claim 4, that is characterised in that the tubular prolongation (93) has a transverse hole (94) for the coupling and fixing of the upper supplement (7) of the modular mast using a pin.

6. A system, according to claim 1, that is characterised in that the safety guard (15) consists of a tubular post (151) that can be coupled to the support (14) and with crosspieces (152) at different heights with transverse holes (153) for mounting telescopic railings (17).

7. A system, according to claim 1, that is characterised in that the plates (161, 162) have two lower holes (163) at their ends, for fixing them to the supports (14) and an upper hole (164) for them to be fixed to the posts (151) of the safety guard (15).

* * * * *